US005800058A

United States Patent [19]

Cook

[11] Patent Number: 5,800,058

[45] Date of Patent: Sep. 1, 1998

[54] VORTEX ELIMINATION DEVICE

[75] Inventor: Daniel D. Cook, Lancaster, N.Y.

[73] Assignee: The Research Foundation of State University of New York, Amherst, N.Y.

[21] Appl. No.: 554,267

[22] Filed: Nov. 6, 1995

[51] Int. Cl.[6] ..... B01F 15/00

[52] U.S. Cl. ..... 366/306; 366/307

[58] Field of Search ..... 366/262, 263, 366/265, 302, 306, 307, 315, 317, 337; 416/178, 184, 186 A, 187

[56] References Cited

U.S. PATENT DOCUMENTS

| | | | |
|---|---|---|---|
| 562,296 | 6/1896 | Haley | 366/307 |
| 975,380 | 11/1910 | Berntson | 366/307 X |
| 1,067,007 | 7/1913 | Douglas . | |
| 1,716,363 | 6/1929 | Brooks | 366/307 |
| 2,064,861 | 12/1936 | Stroud | 366/307 X |
| 2,362,868 | 11/1944 | Upson | 416/178 |
| 2,733,853 | 2/1956 | Trumpler | 416/186 A X |
| 3,136,035 | 6/1964 | Goettl | 416/178 |
| 3,536,416 | 10/1970 | Glucksman | 416/178 |
| 3,690,621 | 9/1972 | Tanaka et al. | 416/184 X |
| 4,303,375 | 12/1981 | Foglesong et al. | 416/186 A X |
| 4,313,680 | 2/1982 | Honnen | 366/337 |
| 4,412,783 | 11/1983 | Barlass | 416/186 A |
| 4,494,878 | 1/1985 | Rainey, Jr. | 366/307 X |
| 4,662,819 | 5/1987 | Lakowske et al. | 416/186 A X |
| 4,893,941 | 1/1990 | Wayte | 366/317 X |

FOREIGN PATENT DOCUMENTS

| | | | |
|---|---|---|---|
| 337179 | 6/1921 | Germany | 416/186 A |

OTHER PUBLICATIONS

Corning, Inc. catalogue, p. 116.

EMI Inc. Rep Training Manual Section 6, pp. 1–15 (Sep. 15, 1993).

EMI Inc. Rep Training Manual Section 7, pp. 1–12 (Sep. 15, 1993).

EMI Brochure, Eastern Portable & Fixed Entry Mixers, Bulletin 5100A (Sep. 1995).

EMI Brochure, Agitation Design Guidelines and Fundamentals.

Oldshue et al., "A Guide to Fluid Mixing," Lightnin, Rochester, N.Y. (1992), pp. 1–153.

*Primary Examiner*—Charles E. Cooley

*Attorney, Agent, or Firm*—Nixon, Hargrave, Devans & Doyle

[57] ABSTRACT

A vortex elimination device, suitable for insertion into a container of liquid, includes an upper end cap, a lower end cap, and a plurality of longitudinally extending vanes connecting the upper and lower end caps. Each of the plurality of vanes has first and second longitudinal edges extending between the upper and lower end caps. The vanes together define a treatment area where the first edge is proximate the treatment area and the second edge is distal from the treatment area. The first edge of each of the plurality of vanes terminates at an open space and is positioned at an angle where the angle is measured between each of the plurality of vane's centerline and a line drawn tangent to the upper and lower end caps where the second edge of each of the vanes and the upper and lower end caps connect. The plurality of vanes can be movably connected to the end caps to permit the angles for the plurality of vanes to be varied. A method of using the device to eliminate vortex action of a liquid and a method of mixing a liquid using the device are also provided.

15 Claims, 8 Drawing Sheets

VORTEX ELIMINATION DEVICE

FIELD OF THE INVENTION

The present invention relates to a device for eliminating vortex action within a container.

BACKGROUND OF THE INVENTION

Proper fluid mixing is at the heart of most scientific laboratory experiments. Typically, impeller-type mixers are used in laboratory vessels to promote mixing. The stirring paddles discharge fluid from the center of the vessel to the vessel walls in a radial direction. However, a tangential flow pattern often is quickly established, typified by rapid swirling of the liquid around the vessel walls and, as a result, inefficient mixing occurs. Further, the vortex action of the liquid promotes air induction into the vessel, causing the liquid components to mix with the air in the center of the vortex. Depending on the nature of the liquids involved in the laboratory experiment, this could have a deleterious effect on the experimental results. Also, the vortex action can cause liquid to swirl over the top of the vessel walls, resulting in spillage.

One means for improving mixing in a laboratory vessel is to provide indentations in the vessel walls to break the tangential flow pattern. These indentations create turbulence, and, thus, promote better mixing by directing the liquid from the vessel walls back to the center of the vessel. However, these indentations do not reduce the vortex action. As a result, extended mixing times are required. Further, laboratory glassware with wall indentations do not have the flexibility required for laboratory experimentation.

The present invention is directed toward overcoming these deficiencies.

SUMMARY OF THE INVENTION

The present invention relates to a vortex elimination device for insertion within a container of liquid. The device includes an upper end cap, a lower end cap, and a plurality of vanes connecting the upper and lower end caps. Each of the plurality of vanes is oriented to eliminate vortex action of a liquid when the device is placed in a container of liquid.

Another aspect of the present invention relates to a vortex elimination device with an upper end cap, a lower end cap, and a plurality of longitudinally extending vanes connecting the upper and lower end caps. Each of the plurality of vanes has first and second longitudinal edges extending between the upper and lower end caps. The vanes together define a treatment area. The first edge is proximate the treatment area, while the second end is distal from the treatment area. The vortex elimination device is suitable to be placed within a container.

Yet another aspect of the present invention relates to a method of using a vortex elimination device which includes providing a container of liquid and placing in the container a vortex elimination device. The device has an upper end cap, a lower end cap, and a plurality of vanes connecting the upper and lower end caps. The device is positioned in the container to eliminate the vortex action of liquid.

Yet another aspect of the present invention relates to a method of mixing a liquid which includes providing a container of liquid, placing in the container a vortex elimination device, and mixing the liquid in the container. The device has an upper end cap, a lower end cap, and a plurality of vanes connecting the upper and lower end caps. The device is positioned in the container to eliminate the vortex action of liquid.

The vortex elimination device of the present invention promotes faster, more efficient mixing of liquid chemical solutions at up to 300% higher stirring speeds.

DETAILED DESCRIPTION OF THE INVENTIONS

The vortex elimination device is intended for insertion into a container of liquid containing separate ingredients. The container may contain one or more types of liquids, or a combination of liquid and undissolved solids. During mixing of the ingredients, vortex action may occur, which is typified by rapid swirling of the liquid around the vessel walls. The positioning of the vanes of the vortex elimination device of the present invention redirects the vortex flow of liquid solutions back toward the center of the mixing container. This allows the stirring paddle (not shown) of the mixer (not shown) to combine more efficiently the separate ingredients present in the container.

Figure 1:
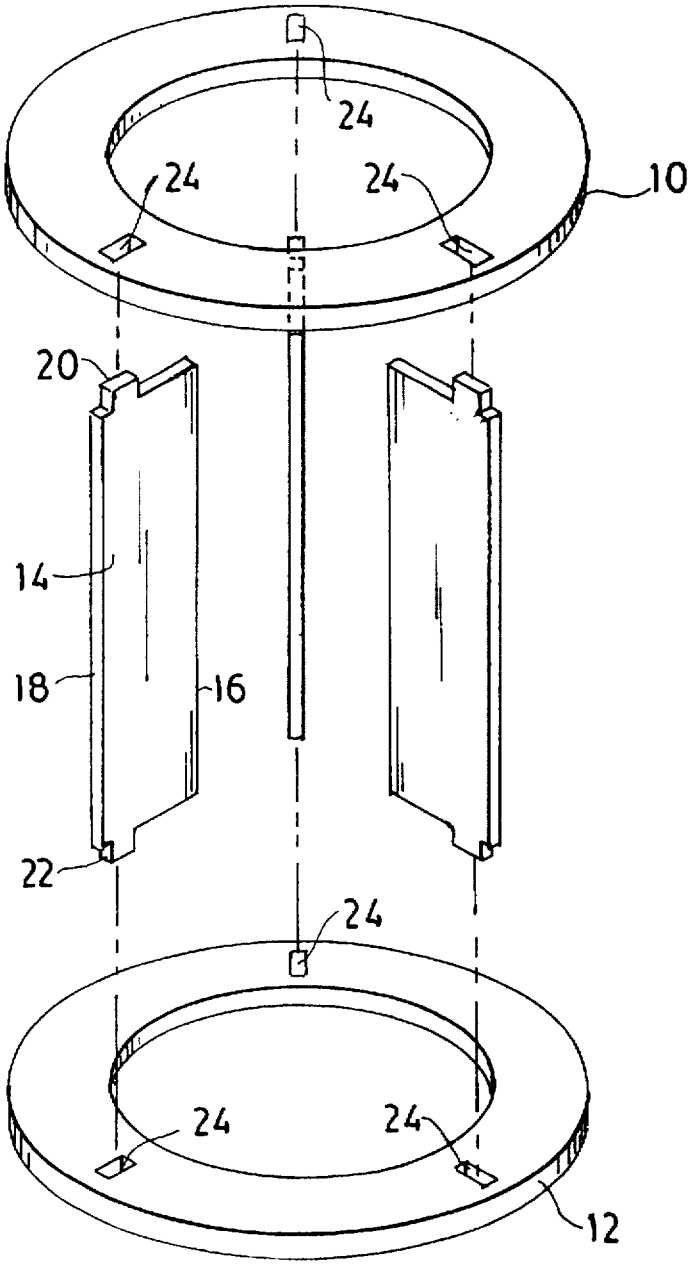
FIG. 1 is an exploded perspective view of a first embodiment of the vortex elimination device of the present invention.
Figure 2:
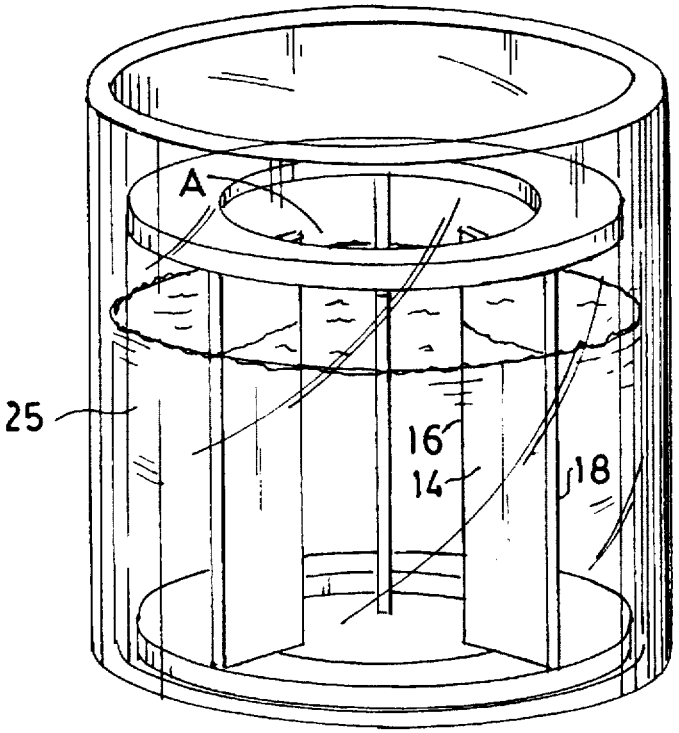
FIG. 2 is a perspective view of the vortex elimination device of FIG. 1 in a container of liquid.

FIGS. 1–3 depict a first embodiment of the vortex elimination device of the present invention. This device includes an upper end cap 10 and a lower end cap 12 with a plurality of longitudinally extending vanes 14 connecting the upper end cap 10 and lower end cap 12. It is especially desirable to have three longitudinally extending vanes 14. Each of the plurality of vanes 14 has a first longitudinal edge 16 and a second longitudinal edge 18. Vanes 14 may be of any shape which is capable of eliminating a vortex. However, it is especially desirable for vanes 14 to be of rectangular or air foil cross-sectional shape. As shown in the embodiment of the invention illustrated in FIG. 6, air foil shaped vane 14 has a thinner first edge 16 than second edge 18. The thickness of vane 14 gradually increases from first edge 16 to second edge 18. The top end of second longitudinal edge 18 of each vane 14 has an axially-extending protuberance 20 and the bottom end of second longitudinal edge 18 of each vane 14 has axially-extending protuberance 22. Upper and lower end caps 10 and 12 have a plurality of openings 24 configured to receive protuberances 20 and 22 of vanes 14. Openings 24, preferably, are slotted or round. Preferably, upper and lower end caps 10 and 12 each have three openings 24. Protuberance 22 on the bottom of each of the plurality of vanes 14 fits into corresponding opening 24 of the lower end cap 12 and protuberance 20 on the top of each of the plurality of vanes 14 fits into the corresponding opening 24 of upper end cap 10, thereby connecting upper and lower end caps 10 and 12.

As shown in FIG. 2, vanes 14 are positioned between the upper and lower end caps 10 and 12 in an orientation which will eliminate vortex action of liquid when the device is placed in a container of liquid 25. Vanes 14 are oriented such that they define a treatment area A for the liquid in container 25. First edge 16 of each of plurality of vanes 14 is proximate treatment area A and second edge 18 is distal from treatment area A. Thus, when placed in container 25, first edge 16 of each of plurality of vanes 14 is toward the center of container 25 while the second edge 18 of each of plurality of vanes is proximate the wall of container 25. The orientation of vanes 14 eliminates the vortex action of the liquid by redirecting the vortex flow from the container walls back toward the center of mixing container 25. As shown in FIG. 2, the vortex elimination device of the present invention fits tightly against the walls of container 25 so that the swirling action of the liquid does not move the device. Alternatively, the vortex elimination device can be provided with a member which attaches the device to the wall of the vessel or a member that frictionally engages the container walls.

Figure 3A:
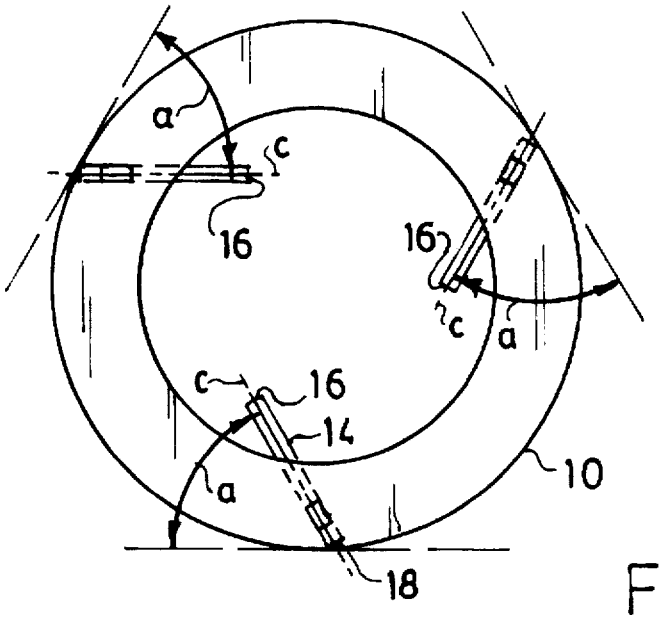
FIGS. 3A and 3B are a top view and a bottom view, respectively, of the vortex elimination device of FIG. 1.
Figure 3B:
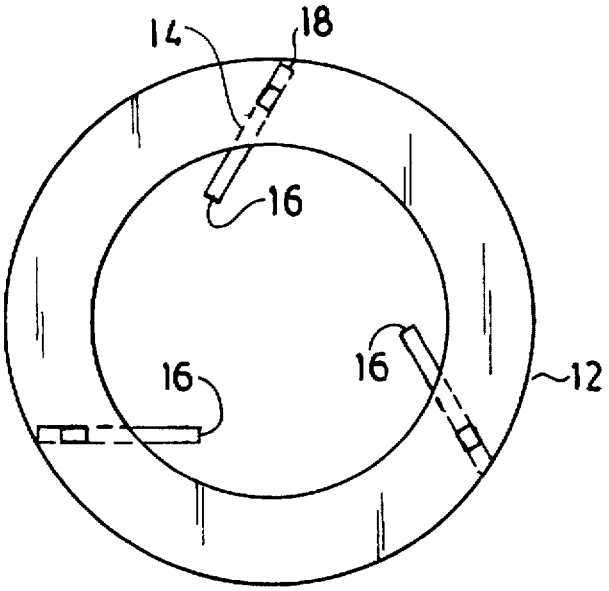

Referring to FIGS. 3A and 3B, vanes 14 are oriented with first edge 16 of each being positioned at angle a between 0° and 180°. Angles a is measured between a line drawn tangent to upper end cap 10 at a position where upper end cap 10 and second edge 18 of each of vanes 14 connect, and the centerline c of each of vanes 14. Preferably, plurality of vanes 14 are positioned, with respect to their respective tangents to end cap 10 where intersected by second edge 18, at an angle a of between 50° to 80°. More preferably, angle a is between 60° and 70°. It is especially desirable that angle a is 63°.

Figure 4:
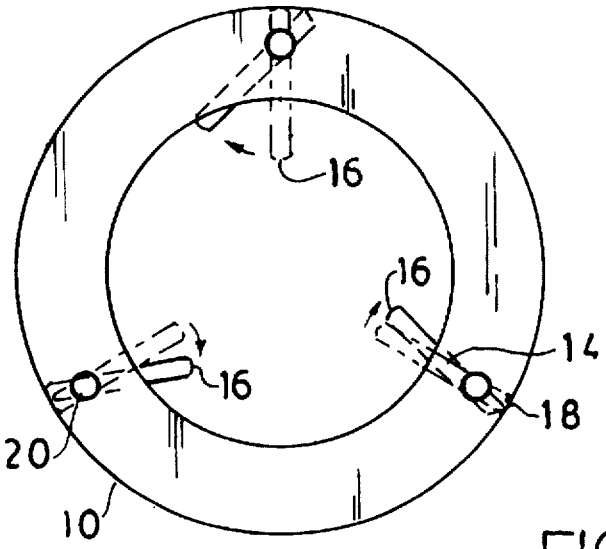
FIG. 4 is a top view of a second embodiment of the vortex elimination device of the present invention.

Vanes 14 can be held in a fixed position by upper and lower end cap 10 and 12 with no relative movement between protuberances 20 and 22 and their corresponding openings 24. It may be advantageous, however, to allow vanes 14 to be repositioned to account for different liquids having a wide range of viscosities. Fluids having low viscosity require greater redirection of the liquid towards the center of the container. By contrast, less redirection is needed where the liquid being mixed has a high viscosity. Thus, it is desirable to have a second embodiment of the present invention in which vanes 14 are movably connected to upper and lower end caps 10 and 12 so that first edges 16 of each of plurality of vanes 14 may be positioned at different angles. The plurality of vanes can be adjusted by any known means. Preferably, protuberance 20 at the top edge and protuberance 22 at the bottom edge of each of vanes 14 and the corresponding openings 24 in upper and lower end cap 10 and 12 are pivot points around which relative movement occurs. It is, therefore, desirable for openings 24 and protuberances 20 and 22 to be circular in this embodiment. Thus, as shown in FIG. 4, each vane 14 is individually, manually, adjustable to reposition vanes 14 at any angle a by turning vanes 14 about their pivot point.

Figure 5:
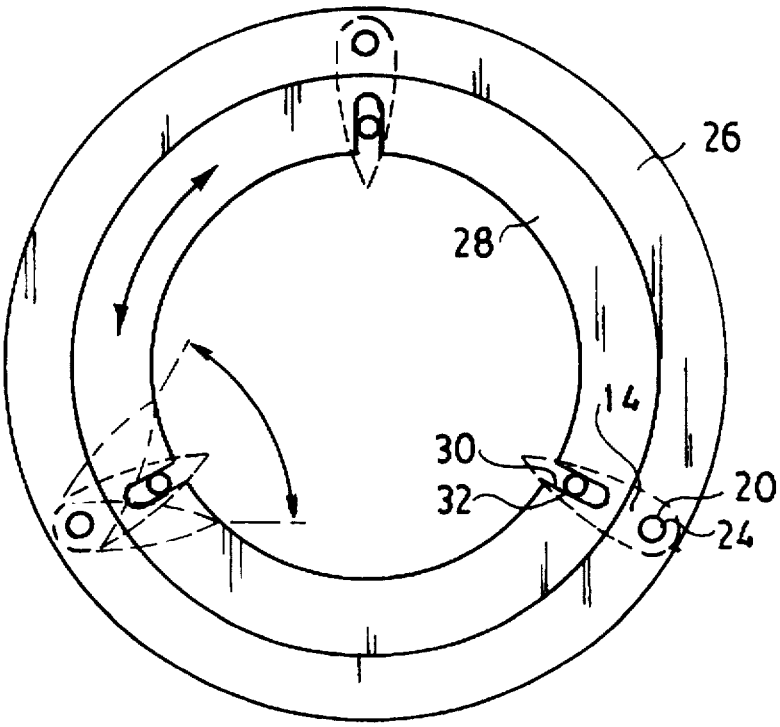
FIG. 5 is a top view of a third embodiment of the vortex elimination device of the present invention.
Figure 6:
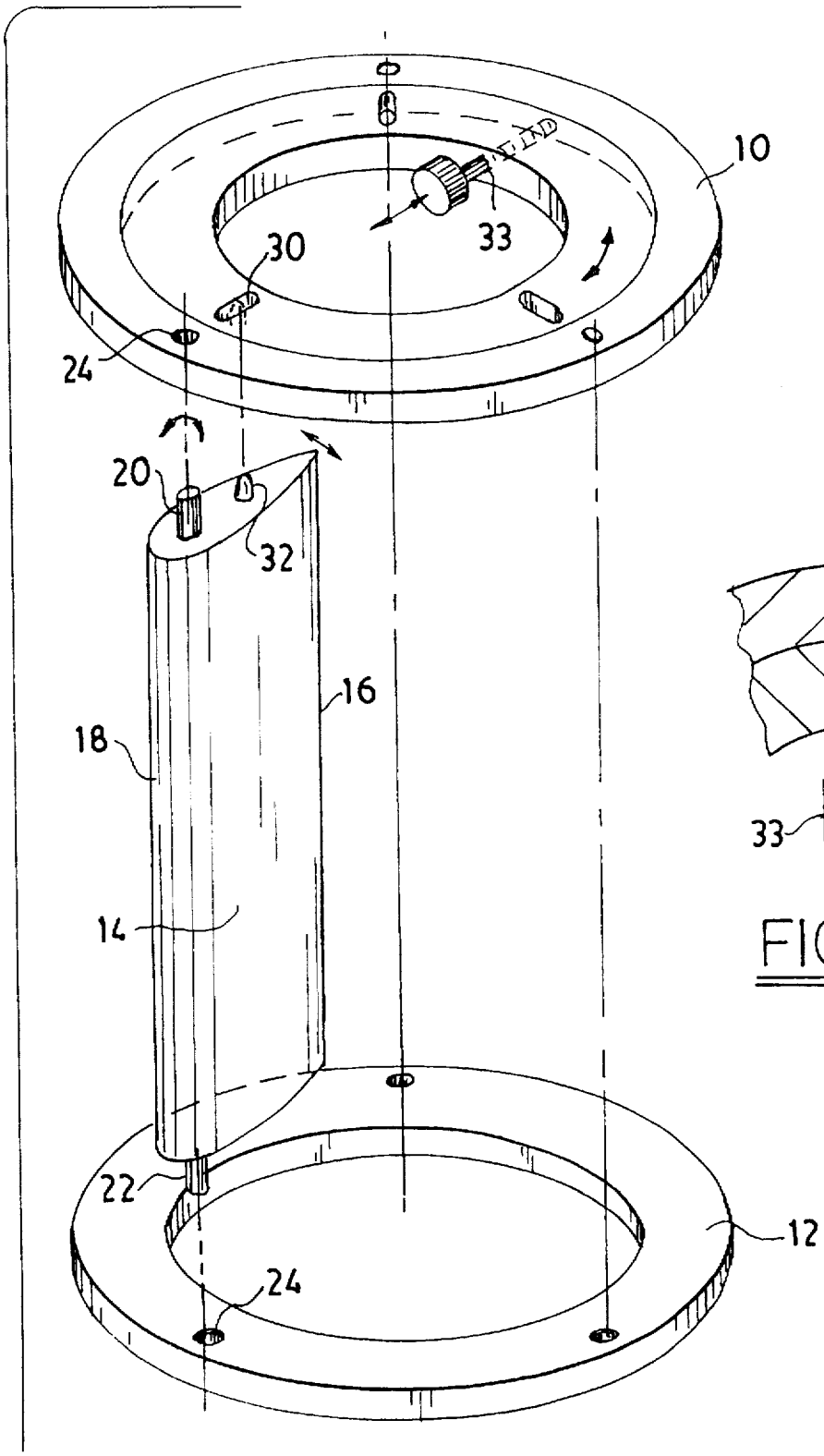
FIG. 6 is a perspective view of the vortex elimination device of FIG. 5.
Figure 6A:
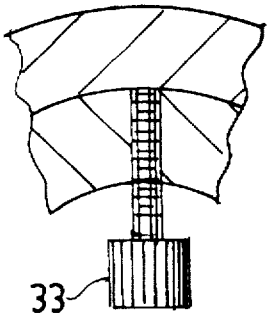
FIG. 6A is a top cross-sectional view of the vortex elimination device of FIG. 6.

It may also be desirable to adjust vanes 14 as a single unit. Referring to FIGS. 5 and 6, which illustrate a third embodiment of the vortex elimination device of the present invention, either or both upper end cap 10 and lower end cap 12 has an outer fixed ring 26 and an inner adjuster ring 28. Preferably, upper end cap 10 includes these two rings. Openings 24 are contained in outer fixed ring 26 and vane protuberances 20 are rotatably mounted in openings 24 to form a pivot point to allow for relative rotation between vane 14 and outer fixed ring 26. As with the embodiment of FIG. 5, vane protuberances 22 are rotatably mounted in openings 24 of lower end cap 12 to form a pivot point. Inner adjuster ring 28 contains slots 30 through which a pin 32 located on each of the top surface of the plurality of vanes 14 is contained. Inner adjuster ring 28 is rotatable and, when turned, causes the movement of vanes 14 by forcing the movement of pins 32 on the top surface of vanes 14 which, in turn, causes movement of vanes 14. Thus, movement of inner adjuster ring 28 forces each of the plurality of vanes 14 to pivot around the pivot point located between protuberances 20 and 22 and openings 24. This orients vanes 14 in a different direction. In this manner, first edge 16 of each of plurality of vanes 14 is positioned at a different angle a. Inner adjuster ring 28 can be turned in a number of ways, including a simple hand adjustment. It may be desirable to include a lock on inner adjuster ring 28 to prevent movement of vanes 14 after adjustment. A preferred locking means, as shown in FIG. 6A, is a set screw 33, which, when tightened, locks adjuster ring 28 in place against cuter fixed ring 26.

Figure 7:
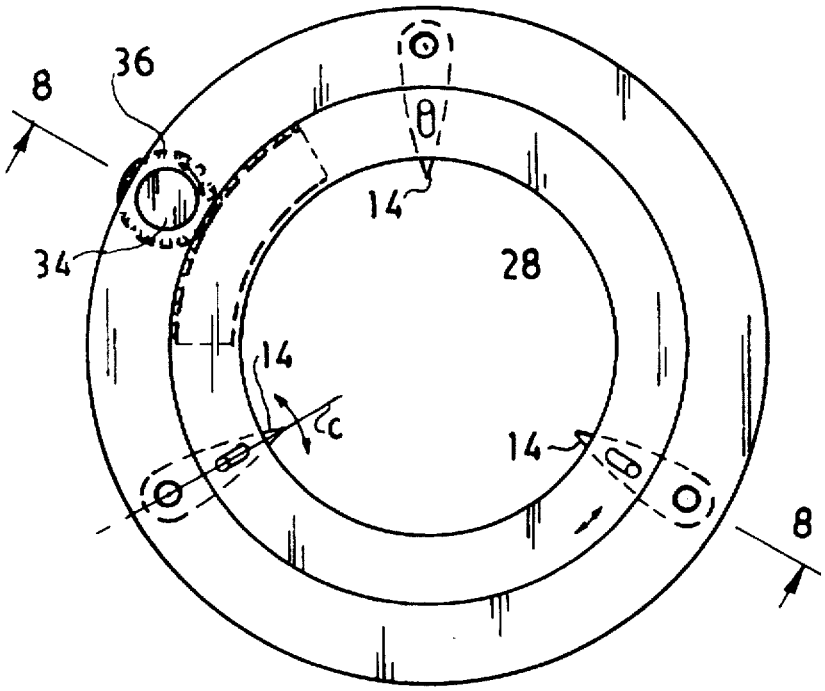
FIG. 7 is a top view of a fourth embodiment of the vortex elimination device of the present invention.
Figure 8:
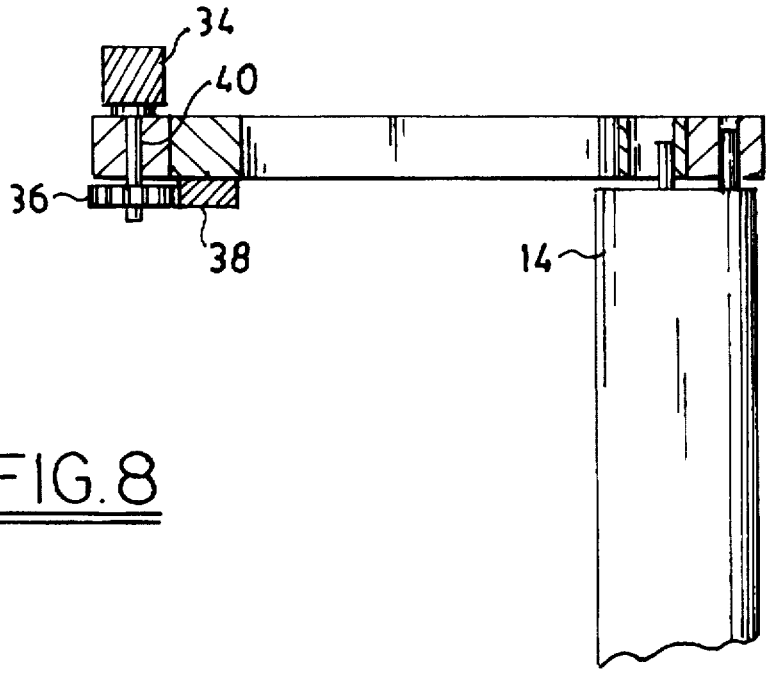
FIG. 8 is a side cut away view of the vortex elimination device of FIG. 7.
Figure 9:
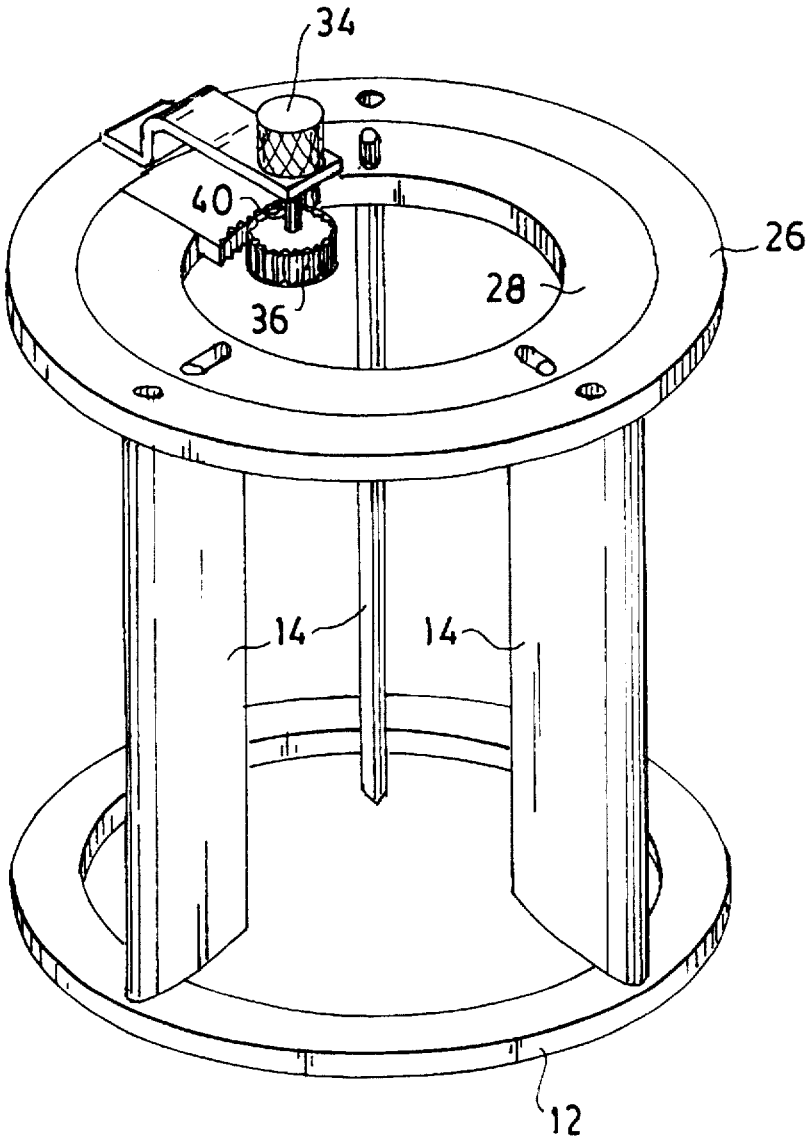
FIG. 9 is a perspective view of the vortex elimination device of FIG. 7.

FIGS. 7–9 show a fourth embodiment of the vortex elimination device of the present invention. This embodiment is also directed toward orienting the vanes to various different positions. As shown, adjuster ring 28, described above with reference to FIGS. 5 and 6, can also be adjusted by a gear and thumbwheel assembly located on inner adjuster ring 28. Thumbwheel 34 is connected to gear 36 by rod 40 having a longitudinally extending axis. Gear 36 meshes with gear segment 38, which is located on and attached to inner adjuster ring 28. Thumbwheel 34 is rotated manually, thereby rotating gear 36. This causes rotation of gear segment 38, and, as a result, of inner adjuster ring 28. This causes plurality of vanes 14 to rotate to the desired angle. Preferably, first edge 16 of each of plurality of vanes 14 is positioned at an angle a, as defined above, between 50° to 80°. However, vanes 14 can be at any angle a between 0° to 180°, to eliminate vortex action of a liquid. More preferably, angle a is between 60° and 70°. It is especially desirable for angle a to be 63°.

Figure 10:
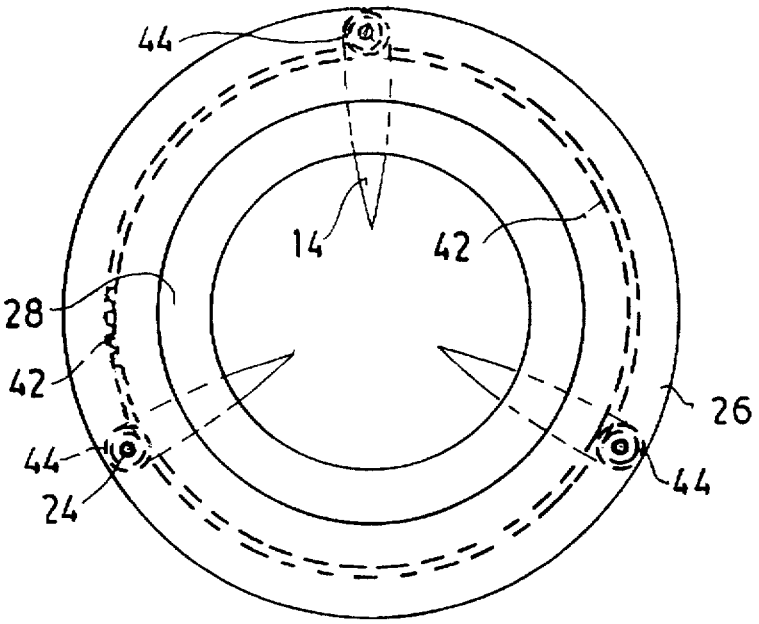
FIG. 10 is a top view of a fifth embodiment of the vortex elimination device of the present invention.
Figure 11:
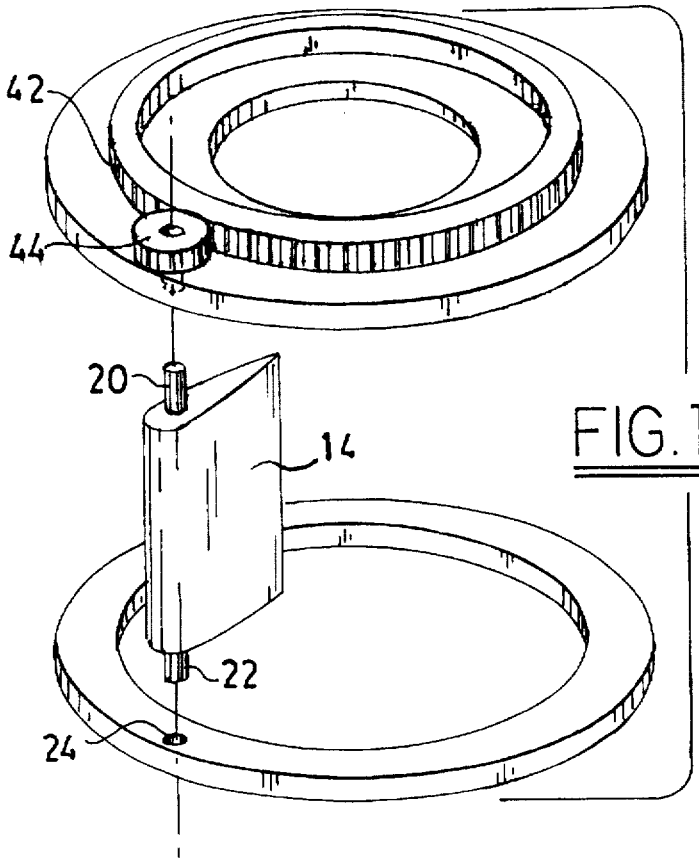
FIG. 11 is an exploded perspective view of the vortex elimination device of FIG. 10.

FIGS. 10 and 11 show a fifth embodiment of the present invention. This embodiment includes an alternative means to adjust angle a, as defined above, of the plurality of vanes 14, using a rack and pinion arrangement. As described above with reference to FIGS. 5 and 6, either or both upper and lower end cap 10 and 12 has outer fixed ring 26 and inner adjuster ring 28. In the embodiment of FIGS. 10 and 11, inner adjuster ring 28 includes a flexible gear rack 42. Alternatively, an externally toothed gear could be used in place of flexible gear rack 42. Rack 42 is a flexible circular gear which meshes with a plurality of gears 44. Each gear 44 is located on the top surface of each of the plurality of vanes 14. By turning rack 42, gears 44 are turned, causing movement of the plurality of vanes 14, which pivot around the pivot point created at the connection of protuberances 20 and 22 and openings 24 for each vane 14. This causes plurality of vanes 14 to rotate to the desired angle a, as defined above.

The device can be made out of a variety of materials to ensure chemical compatibility with all applications. The vanes and the end caps can be constructed of brass, bronze, stainless steel, aluminum, nylon, ceramic, ceramic coated metals, carbon coated composites, plastic, TEFLON® (E.I.

DuPont de Nemours & Co., Wilmington, Del.), DELRIN® (E.I. DuPont de Nemours & Co., Wilmington, Del.), or any other suitable material. The vanes and the end caps can be constructed out of the same, or different, materials. Further, the vanes can be removable from the end caps, and, therefore, are replaceable, allowing different vanes to be used with the same end caps. Thus, vanes of the most desirable material and shape can be utilized for each application. Although it is envisioned that the device be used in laboratory beakers, it may also be used in buckets, cells, vats, cups, glasses, and other laboratory, industrial, and food industry containers.

In use, the vortex elimination device is inserted within a container of liquid 25 to eliminate vortex action of the liquid. When placed in container 25 which contains liquid swirling around container 25 walls in a vortex action, the position of vanes 14 of the device redirects the flow from the swirling action around the vessel walls back towards the center of the mixing area. Further, the device is placed into container of liquid 25, the liquid in the container is mixed, and the device will prevent vortex action of the liquid by redirecting the flow proximate the container walls back to the center of the container.

Although the invention has been described in detail for the purpose of illustration, it is understood that such detail is solely for that purpose, and variations can be made therein by those skilled in the art without departing from the spirit and scope of the invention which is defined by the following claims:

What is claimed:

1. A vortex elimination system comprising:

a container of liquid; and a vortex elimination device comprising:

an upper end cap;

a lower end cap; and a plurality of longitudinally extending vanes connecting said upper and lower end caps, wherein each of said plurality of vanes has first and second longitudinal edges extending between said upper and lower end caps with said vanes together defining a treatment area when placed within the container of liquid, wherein the first edge is proximate the treatment area, while the second edge is distal from the treatment area, wherein the first edge of each said plurality vanes terminates at an open space and wherein the first edge of each of said plurality of vanes is positioned at an angle wherein the angle is measured between each of said plurality of vane's centerline and a line drawn tangent to said upper and lower end caps where the second edge of each of the vanes and said upper and lower end caps connect and wherein said plurality of vanes are movably connected to said end caps to permit the angles for said plurality of vanes to be varied, wherein the vortex elimination device remains stationary in the container of liquid.

2. A vortex elimination device according to claim 1, wherein the angle is between 50° and 80°.

3. A vortex elimination device according to claim 2, wherein the angle is between 60° to 70°.

4. A vortex elimination device according to claim 3, wherein one of said end caps comprises a fixed ring and rotatable ring concentric to the fixed ring, said rotatable ring being adjustable so that the plurality of vanes can be moved by rotating the rotatable ring.

5. A vortex elimination system according to claim 1, wherein the angles for said plurality of vanes can be varied between 0° and 180°.

6. A method of using a vortex elimination device, said method comprising:

providing a container of liquid and placing in the container a vortex elimination device which comprises:

an upper end cap;

a lower end cap; and a plurality of vanes connecting said upper and lower end caps, wherein each of said plurality of vanes has first and second longitudinal edges extending between said upper and lower end caps with said vanes together defining a treatment area when placed within the container of liquid, wherein the first edge is proximate the treatment area, while the second edge is distal from the treatment area, wherein the first edge of each of said plurality of vanes is positioned at an angle wherein the angle is measured between each of said plurality of vane's centerline and a line drawn tangent to said upper and lower end caps where the second edge of each of the vanes and said upper and lower end caps connect and wherein said plurality of vanes are movably connected to said end caps to permit the angles for said plurality of vanes to be varied, whereby the device eliminates vortex action of the liquid in said container.

7. A method according to claim 6, wherein the angle is between 50° and 80°.

8. A method according to claim 7, wherein the angle is between 60° and 70°.

9. A method according to claim 8, further comprising:

adjusting the angle of the plurality of vanes.

10. A method according to claim 9, wherein said adjusting step comprises:

rotating a rotatable ring connecting said end caps and the plurality of vane.

11. A method according to claim 6, wherein the angles for said plurality of vanes can be varied between 0° and 180°.

12. A method of mixing a liquid, said method comprising:

providing a container of liquid;

placing in the container a vortex elimination device which comprises:

an upper end cap;

a lower end cap; and a plurality of vanes connecting said upper and lower end caps, wherein each of said plurality of vanes has first and second longitudinal edges extending between said upper and lower end caps with said vanes together defining a treatment area when placed within the container of liquid, wherein the first edge is proximate the treatment area, while the second edge is distal from the treatment area, wherein the first edge of each of said plurality of vanes is positioned at an angle wherein the angle is measured between each of said plurality of vane's centerline and a line drawn tangent to said upper and lower end caps where the second edge of each of the vanes and said upper and lower end caps connect and wherein said plurality of vanes are movably connected to said end caps to permit the angles for said plurality of vanes to be varied; and mixing the liquid in the container, whereby the device eliminates vortex action of liquid in said container.

13. A method of mixing according to claim 12, further comprising:

adjusting the angle of each of the plurality of vanes.

14. A method of mixing according to claim 13, wherein the adjusting step comprises:

rotating a rotatable ring connecting the end caps and the plurality of vanes.

15. A method according to claim 12, wherein the angles for said plurality of vanes can be varied between 0° and 180°.

* * * * *